US009743464B2

(12) United States Patent
Seewald et al.

(10) Patent No.: US 9,743,464 B2
(45) Date of Patent: Aug. 22, 2017

(54) HEAT EXCHANGER DEVICE AND HEATER

(71) Applicant: MAHLE International GmbH, Stuttgart (DE)

(72) Inventors: Wolfgang Seewald, Tamm (DE); Karl-Gerd Krumbach, Burgstetten (DE); Michael Kohl, Beitigheim-Bissingen (DE)

(73) Assignee: MAHLE International GmbH, Stuttgart (DE)

( * ) Notice: Subject to any disclaimer, the term of this patent is extended or adjusted under 35 U.S.C. 154(b) by 413 days.

(21) Appl. No.: 14/306,466

(22) Filed: Jun. 17, 2014

(65) Prior Publication Data

US 2014/0374408 A1 Dec. 25, 2014

(30) Foreign Application Priority Data

Jun. 19, 2013 (DE) ..... 10 2013 211 579

(51) Int. Cl.

| | |
|---|---|
| ***H05B 3/82*** | (2006.01) |
| ***F28F 1/42*** | (2006.01) |
| ***H05B 6/10*** | (2006.01) |
| ***F24H 1/10*** | (2006.01) |
| ***F24H 9/00*** | (2006.01) |
| ***F24H 9/18*** | (2006.01) |

(52) U.S. Cl.

CPC ..... *H05B 6/108* (2013.01); *F24H 1/101* (2013.01); *F24H 9/0015* (2013.01); *F24H 9/1818* (2013.01); *F24H 2250/08* (2013.01); *F28F 1/42* (2013.01); *F28F 1/422* (2013.01); *H05B 2206/024* (2013.01)

(58) Field of Classification Search

CPC .... H05B 6/108; H05B 3/82; H05B 2206/024; F24H 1/101; F24H 9/0015; F24H 9/1818; F28F 1/42; F28F 1/422; F28F 1/426

USPC ..... 219/628–630, 632, 620; 392/397, 398

See application file for complete search history.

(56) References Cited

U.S. PATENT DOCUMENTS

| | | | | | |
|---|---|---|---|---|---|
| 1,513,087 | A | * | 10/1924 | Buhl | H05B 6/108 219/116 |
| 2,407,562 | A | * | 9/1946 | Lofgren | H05B 6/108 219/630 |
| 4,471,191 | A | * | 9/1984 | Greis | F24H 1/101 219/629 |
| 4,690,211 | A | * | 9/1987 | Kuwahara | B21C 37/207 138/38 |

(Continued)

FOREIGN PATENT DOCUMENTS

| | | |
|---|---|---|
| DE | 1 054 191 B | 4/1959 |
| DE | 1 855 170 U | 7/1962 |

(Continued)

*Primary Examiner* — Arthur O Hall
*Assistant Examiner* — Joseph A Greenlund
(74) *Attorney, Agent, or Firm* — Muncy, Geissler, Olds & Lowe, P.C.

(57) ABSTRACT

A heat exchanger device for a heater a motor vehicle, having a housing with at least one fluid channel disposed therein, with a fluid inlet and a fluid outlet, an element generating an alternating magnetic field, and at least one, preferably metallic, flat heating element around which a fluid can flow on one or both sides, whereby at least one further flat heating element is provided, which is configured to divide the at least one fluid channel into subchannels. A heater with a heat exchanger device is also provided.

18 Claims, 9 Drawing Sheets

(56) References Cited

U.S. PATENT DOCUMENTS 4,791,262 A * 12/1988 Ando ..... H05B 6/108 219/630
5,216,215 A * 6/1993 Walker ..... F24H 1/162 219/630
5,577,555 A * 11/1996 Hisajima ..... F25B 15/06 165/109.1
5,697,430 A * 12/1997 Thors ..... F28F 1/36 165/133
5,833,450 A * 11/1998 Wunning ..... F23D 14/22 126/91 A
5,919,388 A * 7/1999 Kawano ..... B23P 19/068 219/632
5,958,273 A * 9/1999 Koch ..... B01J 8/0285 219/651
5,990,465 A * 11/1999 Nakaoka ..... H05B 6/108 219/629
7,069,640 B2 * 7/2006 Fuseya ..... B29C 45/14639 219/630
7,145,114 B2 * 12/2006 Wakamatu ..... F22B 1/281 219/629
2003/0215226 A1 * 11/2003 Nomura ..... F22G 1/165 392/397
2006/0016582 A1 * 1/2006 Hashimoto ..... F28D 7/1684 165/109.1
2008/0011336 A1 * 1/2008 Hamaguchi ..... F24H 1/101 134/105
2008/0184732 A1 * 8/2008 Hadler ..... B60H 1/00885 62/503
2010/0132921 A1 * 6/2010 Moskal ..... B21D 53/02 165/104.19
2010/0213190 A1 * 8/2010 Bron ..... F24H 1/142 219/629
2014/0027444 A1 * 1/2014 Kohl ..... B60H 1/2221 219/629
2014/0374409 A1 * 12/2014 Seewald ..... H05B 6/36 219/630
2016/0157303 A1 * 6/2016 Heeper ..... H05B 6/108 219/630

FOREIGN PATENT DOCUMENTS

DE 2 003 133 A1 7/1971
DE 33 09 297 A1 9/1984
DE 10 2008 056 991 A1 5/2010
DE 10 2008 044 280 A1 6/2010
EP 2 689 946 A1 1/2014
FR 2 873 433 A1 1/2006
GB 755 570 A 8/1956
GB 787 125 A 12/1957
WO WO 2009/130761 A1 10/2009
WO WO 2011/013144 A2 2/2011

* cited by examiner

HEAT EXCHANGER DEVICE AND HEATER

This nonprovisional application claims priority under 35 U.S.C. §119(a) to German Patent Application No. 10 2013 211 579.2, which was filed in Germany on Jun. 19, 2013, and which is herein incorporated by reference.

BACKGROUND OF THE INVENTION

Field of the Invention

The invention relates to a heat exchanger device for a heater, and a heater, particularly for a motor vehicle.

Description of the Background Art

Heaters are known from the conventional art. Thus, there are air-side heaters, which have so-called PTC heating elements, which are supplied with electric current and are heated thereby. The heat is transferred to the circulating air via air-side lamellae, which are in contact with the PTC elements. These heaters, however, have a basically different structure than is necessary for liquid media.

Heaters for liquid media are provided with a closed housing. They are formed with a fluid channel, which has a fluid inlet and a fluid outlet, whereby a heating element, heated with a PTC element, projects into the housing.

A heater, which has a housing with a fluid channel, disposed therein, with a fluid inlet and a fluid outlet, is known from the unpublished patent application of the applicant, whereby an element, which generates an alternating magnetic field and is separated sealed off from the fluid channel by at least one wall, is provided in the housing, whereby at least one metallic flat heating element is provided, which can be heated by the alternating magnetic field, whereby the at least one flat heating element is disposed in the fluid channel.

SUMMARY OF THE INVENTION

It is therefore an object of the invention to provide a heater which is improved compared with the conventional art and in which the heating of the flowing fluid is optimized.

The heat exchanger device for a heater particularly of a motor vehicle, according to an exemplary embodiment, has a housing with at least one fluid channel, disposed therein, with a fluid inlet and a fluid outlet, an element generating an alternating magnetic field, and at least one, preferably metallic, flat heating element around which a fluid can flow on one or both sides, whereby a further flat heating element is provided, which is configured to divide the at least one fluid channel into subchannels. The at least one and further flat element are heated by the alternating magnetic field and can release their heat to the fluid flowing around the at least one and further flat heating element. The element generating the alternating magnetic field can be disposed sealed off from the fluid by a wall and thus disposed outside the fluid channel and the fluid flow through the fluid channel. The at least one and further flat heating element can be disposed in one of the fluid channels, whereby an electrical separation of the electrical system (element generating the alternating magnetic field, flat heating element) is achieved. The further flat heating element, in addition to the at least one flat heating element, can take up a heat output portion of the alternating magnetic field. The at least one flat heating element can be a first flat heating element, disposed within the element generating the alternating magnetic field. The element generating an alternating magnetic field is preferably an induction coil.

A second flat heating element, disposed outside the element generating the alternating magnetic field, can be provided. The further flat heating element can be disposed directly adjacent to the second flat heating element. Especially preferably it is arranged outside the second flat heating element. Thus, four fluid channels for the fluid can be realized.

The second and further flat heating element can have a contact, as a result of which the heat output density per flat heating element is divided and can be reduced thereby. The heat output density of the second flat healing element in particular can be optimized.

Especially advantageous is the division of the fourth outer fluid channel into the two subchannels, because an optimized flow through and around the heated flat heating elements (second flat heating element and third flat heating element) is made possible. The heat transfer to the fluid can thereby be designed optimally because partial volume flows, which flow along both sides of the third flat heating element in the same direction in the fluid channel, can be formed for the optimized heat transfer.

The further flat element can have cross-mixing elements. Cross-mixing of the fluid flowing in the two subchannels, particularly in the fourth fluid channel, is enabled as a result. A cylindrical first flat heating element when viewed from the central axis is disposed for a cylindrical heat exchanger device. It is surrounded by the cylindrical induction coil. The second flat heating element can be arranged cylindrically around the induction coil. The cylindrical third flat heating element is adjacent when viewed radially outward. The heat transfer can be improved in this way. A cross-mixing is especially advantageous, because the fluid during entry into the fourth fluid channel is often distributed nonuniformly. The cross-mixing elements can realize flow paths between the two subchannels of the fourth fluid channel.

In an embodiment, the cross-mixing elements have openings by means of which the fluid can flow through the further third flat heating element. The fluid in so doing enters from the fluid channel, particularly one of the subchannels located on the one side of the further flat heating element, into the subchannel located on the other side. The openings are preferably formed in that the further flat heating element has straight sections and sections with bulges. The straight sections and the sections with bulges and openings are arranged alternately, so that connecting channels, arranged distributed over the length of the flat heating element, or flow paths for the passage for the fluid from one into another subchannel are formed. The cross-connecting elements can also be formed by slits or in general by inserted recesses in the straight sections of the third flat heating element.

The further flat heating element can have a geometric design by means of which spacing of two adjacently arranged flat heating elements can be realized. The design of the flat heating element can also be realized with a spacing of the flat heating element to an interior wall of the housing. The geometric design can comprise bulges, ripples, more generally elements that project over the surface, particular the surface of the straight section of the flat heating element, but are made as a single piece with it. In this case, preferably two functions can be realized, particularly passing of the fluid from one subchannel to another subchannel and maintaining a space between the further flat heating element and the adjacently arranged second flat heating element with the one further flat heating element.

The geometric design of the further flat heating element can have a geometric structure, which is configured and designed to realize a turbulating and swirling of the fluid flowing through the subchannels. This can be achieved especially by the geometric arrangement of the cross-mixing elements, particularly the bulges and openings over the surface of the flat heating element. The particular geometric form of the bulge can also be designed variably. The bulges can be arranged "on gaps," as a result of which, when viewed in the flow direction, straight sections and sections with bulges are arranged alternately.

It is also advantageous, if the further flat heating element divides the at least one fluid channel into subchannels in such a way that a lowest possible pressure drop and a maximum possible heat removal to the coolant in the fluid channel are realized. The maximum possible heat removal can be increased by the design of the further flat heating element by increasing the surface that can be used for heat transfer. The arising pressure drop can be reduced in addition by dividing a fluid channel into a plurality of subchannels.

The further flat heating element has impressions and/or ribbing. As a result, a pressure drop can be introduced selectively on the fluid side.

The flat heating elements can be made of a material that has a higher electrical resistivity than the material of the element generating the alternating magnetic field (induction coil); in particular, the flat heating elements include an iron-containing material. As a result, a highly efficient conversion of electromagnetic energy into thermal energy can be achieved. The induction coil in this case has a highly conductive copper, particularly an HF copper (high-frequency copper).

The iron-containing material of the further flat heating element can be a ferritic material. The first flat heating element can be made of a ferritic material, the second flat heating element can be made of an austenitic material, and the third flat heating element can be made of a ferritic material.

The second flat heating element can consequently be penetrated by the alternating magnetic field and the third flat heating element can capture the remaining magnetic field and convert it by induced eddy currents into thermal energy. In this way, an optimized division of the heat output portions into flat heating elements disposed within and outside the induction coil can occur.

The further flat heating element can be designed in such a way that the further flat heating element can be installed in a flat and/or cylindrical housing. The flat heating elements can therefore be designed as cylindrical or be present as planar elements and be arranged vertically or horizontally. The further third flat heating element in this case may have bulges and openings and/or slits and ripples and/or impressions and ribbing in vertical or horizontal sections.

It is also advantageous, if two adjacent flat heating elements are connected to one another form-fittingly and/or by material bonding. This is especially advantageous, because this simplifies the assembly. Particularly if the flat heating element directly adjacent to the housing is connected to the inwardly adjacent flat heating element, supporting of the outer flat heating element on the housing can be avoided, as a result of which the risk of catching between the flat heating element and the housing during assembly is prevented. The flat heating elements can be connected in the area of the spacer elements, which are formed, for example, by pronounced nub-like projections.

The heater having a heat exchanger device of the invention can have a control unit for controlling the element generating an alternating magnetic field and the flat heating elements, whereby the heat exchanger device has a housing with at least one fluid channel, disposed therein, with a fluid inlet and a fluid outlet and an element generating an alternating magnetic field, as well as at least one, preferably metallic, flat heating element around which a fluid flows on one or both sides, whereby a further flat heating element is provided, which is configured to divide the at least one fluid channel into subchannels.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
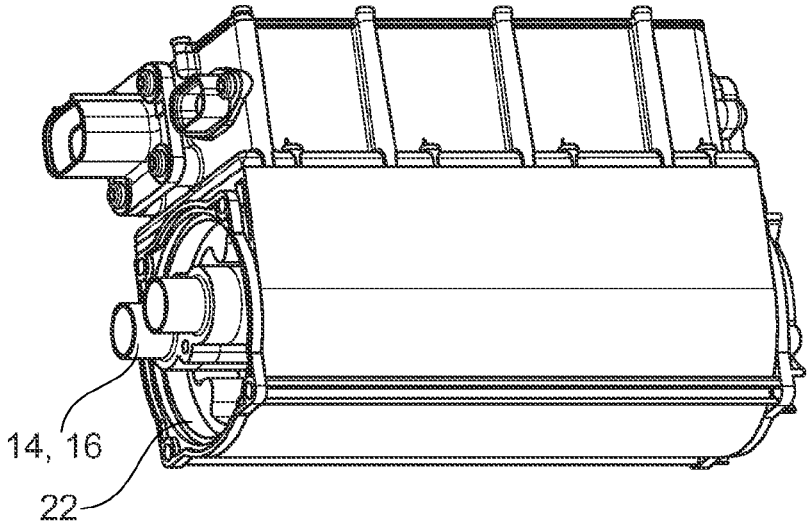
FIGS. 1*a* and 1*b* illustrate a heater of the invention in an assembled state.
Figure 1B:
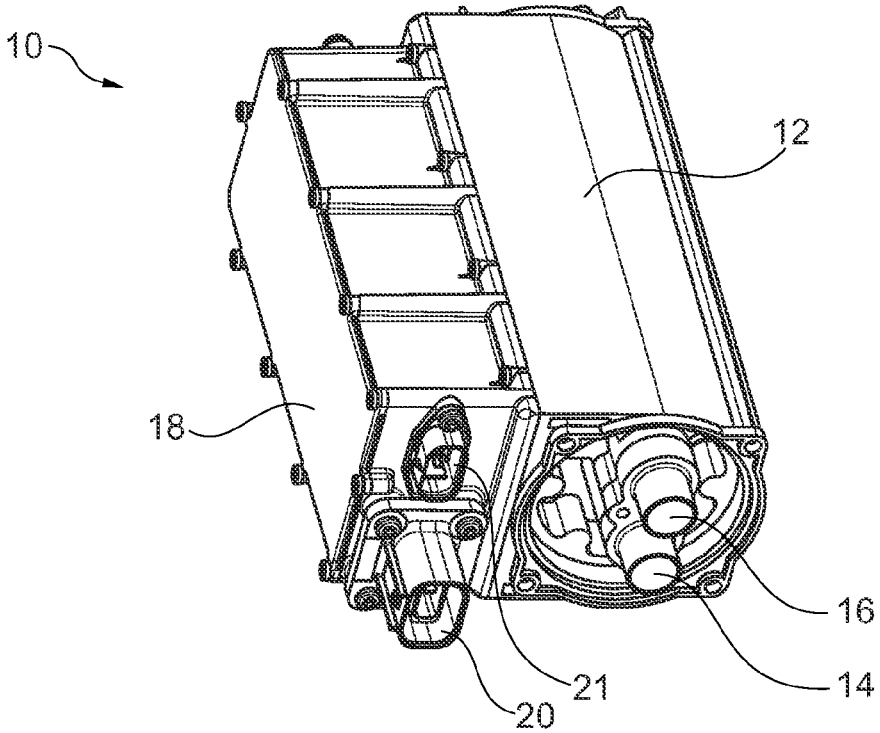

FIG. 1*a* shows a first exemplary embodiment of a heater 10 of the invention with a heat exchanger device 12 with a fluid inlet 14 and a fluid outlet 16 and a control unit 18 in a perspective illustration viewed from the side. Fluid inlet 14 and fluid outlet 16 are located on a connecting flange 22. Control unit 18 has a HV (high-voltage) connector 20 and a LV (low-voltage) connector 21, FIG. 1*b* shows heater 10 of FIG. 1*a* in an illustration rotated 90° with the same components.

Figure 2:
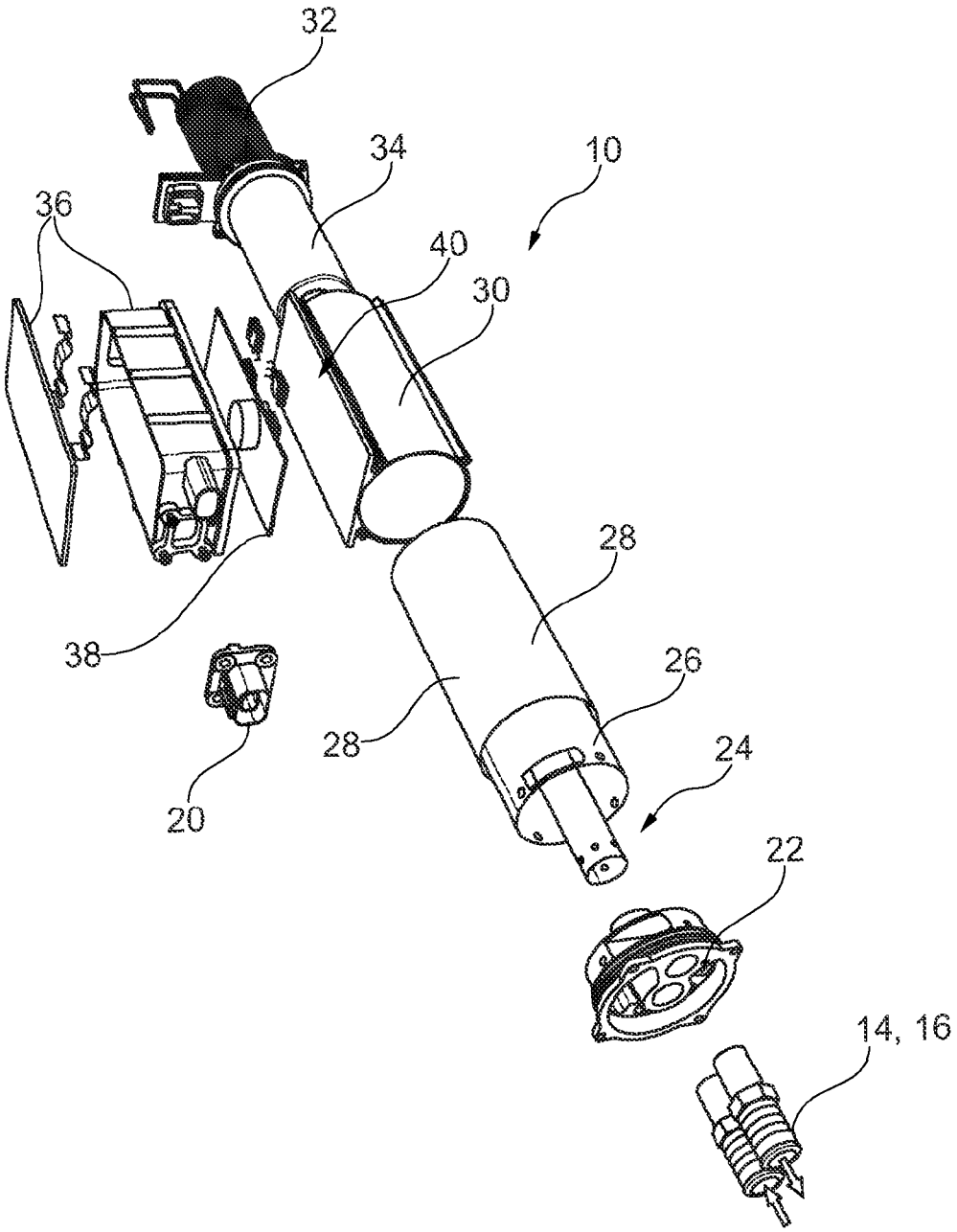
FIG. 2 is a heater according to an embodiment of the invention in an exploded drawing.

FIG. 2 shows heater 10 in an exploded illustration. Identical parts are provided with the same reference characters. Heat exchanger device 12 has fluid inlet 14 and fluid outlet 16, which are arranged on and at least in sections in connecting flange 22. Connecting flange 22 is also called coolant connecting cover 22. A fluid inlet or a fluid outlet 14, 16, which can be configured as connecting pieces, can be provided on connecting flange 22 or coolant connecting cover 22. Alternatively, a single flange can be provided at one of the openings in connecting flange 22 or a shared flange on both openings in the connecting flange. External fluid connecting lines can be connected via the connecting pieces or the flange. Both the connecting pieces and the flange can be made in this case as a single piece with connecting flange 22.

The actual heat exchanger device with a first internal flat heating element 24 is located on and at least in sections in connecting flange 22. First flat heating element 24 is preferably made as a stainless steel tube. A second flat heating element 26 and a third flat heating element 28 are placed around first flat heating element 24. In this illustration in FIG. 2, the third flat heating element is shown as a smooth sheet, but preferably third flat heating element 28 has slits and/or bulges and/or ripples and/or openings. A detailed illustration of third flat heating element 28 is shown in FIG. 6.

Flat heating elements 24, 26, and 28 are accommodated in a housing 30. Housing 30 is preferably an aluminum housing, preferably an extruded aluminum cylinder. Housing 30 is preferably a cylindrical housing 30.

Further, an element 32 generating an alternating magnetic field is disposed in housing 30. Element 32 generating an alternating magnetic field is preferably an induction coil 32, especially preferably a hollow cylindrical induction coil 32. Induction coil 32, however, can also be designed as a flat induction coil 32, particularly if it is used in a flat heat exchanger device. Element 32 generating an alternating magnetic field is accommodated in an element housing 34, preferably a coil housing 34.

Control unit 18, which has high-voltage power electronics 38 accommodated in an electronics housing 36, is disposed adjacently on housing 30. Electronics housing 36 is preferably made of aluminum. Preferably, electronics housing 36 is connected on the side to housing 30 and disposed at or on a connecting plate 40. Housings 30 and 36 are preferably connected mechanically, so that heater 10 can be installed as a device, for example, in a motor vehicle.

Flat heating elements 24, 26, and 28 are preferably made as hollow cylinder or flat elements and of a metal. Preferably, flat heating elements 24, 26, 28 are made as thin sheets with a wall thickness approximately within a range between 0.08 mm and 0.5 mm. First flat heating element 24 is preferably made of a ferritic material and can take up approximately between 20% and 40% of the heat output from the alternating magnetic field. Second flat heating element 26 is preferably made of an austenitic material and can take up approximately 50% to 70% of the heat output. Third flat heating element 28 is preferably made of a ferritic material and can take up approximately 5% to 15% of the heat output.

The materials from which flat heating elements 24, 26, 28 are made all have an electrical resistivity, which is much higher than that of the induction coil, which is produced, e.g., from copper, particularly from a HF copper (high-frequency copper).

The penetration depth of the magnetic field and thereby the region in which eddy currents flow is described by the skin effect. If the penetration depth is greater than the material thickness of the flat heating element, a plurality of individual thin flat heating elements can also be "connected" one behind the other. This is the case, e.g., in second flat heating element 26 with an austenitic material. It is possible due to the small thickness of the flat heating elements that more than one flat heating element is penetrated. This allows for the series connection of the second and third flat heating elements 26 and 28.

Figure 3:
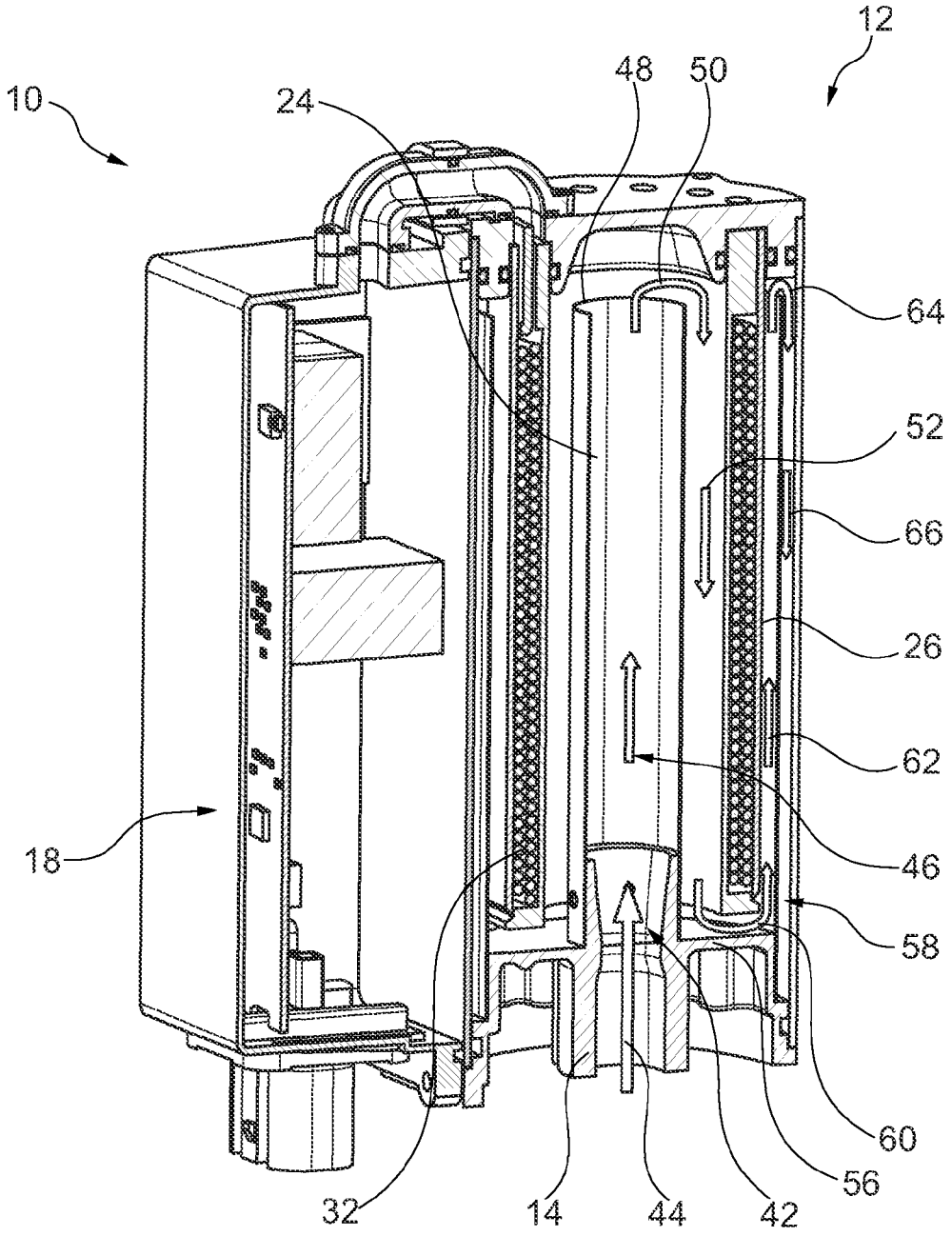
FIG. 3 is a heater with a heat exchanger device.

FIG. 3 shows heater 10 in a sectional illustration. Heater 10 is also called an induction heater 10. In FIG. 3, flow courses for a fluid flowing through heat exchanger device 12 are also shown in addition to the components of heater 10. The fluid enters through fluid or coolant inlet 14, particularly its inlet flange 22, into the interior of heat exchanger device 12. The flow direction of the fluid is indicated by an arrow 44 and is designated as inlet flow direction 44. The fluid flows through a first fluid channel 46 formed by first flat heating element 24.

The straight flow direction 46 is redirected at a fluid channel end 48 and forms a U-turn flow, which is designated by an arrow 50. The fluid can flow substantially parallel, but with an opposite direction, shown by an arrow 52, along the outer wall of first flat heating element 24, until the fluid has reached the other end 54 of first flat heating element 24. End 54 is connected to connecting flange 42 in such a way that fluid can no longer enter the interior of first flat heating element 24. As a result and due to a wall 56, second fluid channel 52 is regarded as closed in flow direction 52.

A passage 58, through which the fluid is redirected into a flow path 60 indicated by arrow 60 and enters third fluid channel 62, is formed between wall 56 and induction coil 32 arranged radially around first flat heating element 24. Third fluid channel 62 is formed on one side by the sealed (electrically and mechanically) induction coil body 34 and on the other side by second flat heating element 26. At the end of third fluid channel 62, the fluid is once again redirected, as shown by arrow 64, into a fourth fluid channel 66, whereby the flow direction of the fluid points in the direction of fluid outlet 16, not shown in FIG. 3, located next to fluid inlet 14.

Figure 4A:
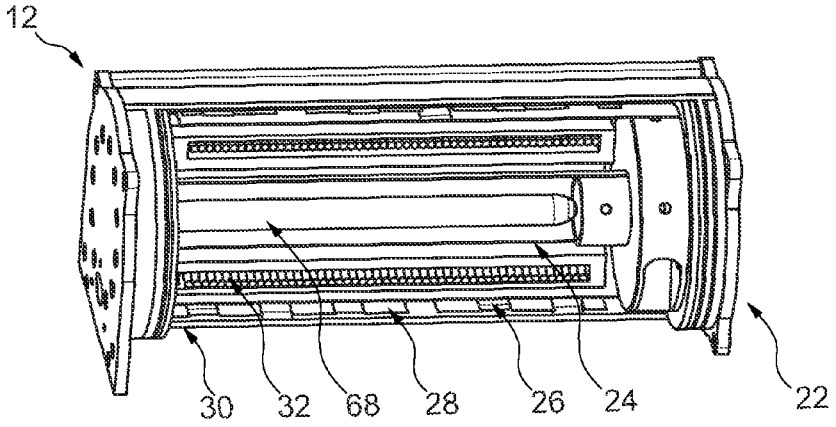
FIGS. 4*a*, 4*b*, 4*c* illustrate a heat exchanger device in different perspective illustrations.

FIG. 4*a* shows heat exchanger device 12 with housing 30, coil housing 34, first flat heating element 24, second flat heating element 26, and third flat heating element 28, as well as coolant sealing cover 22. Induction coil 32 itself can also be seen.

Figure 4B:
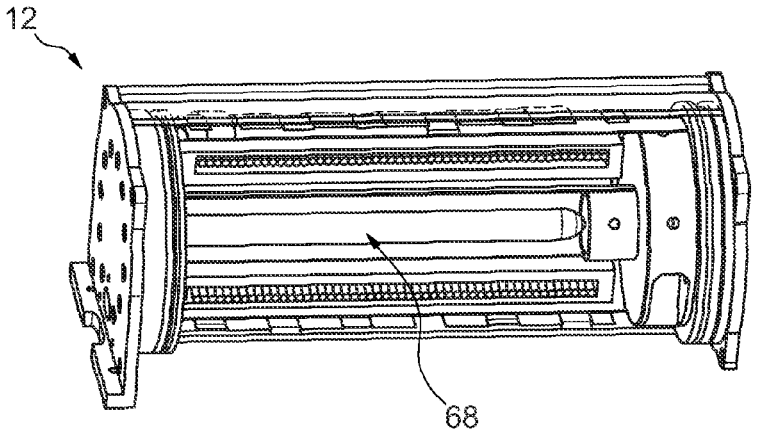

FIG. 4*b* shows heat exchanger device 12 with the same components, whereby an inner mandrel 68 can be seen due to the different sectional plane.

Figure 4C:
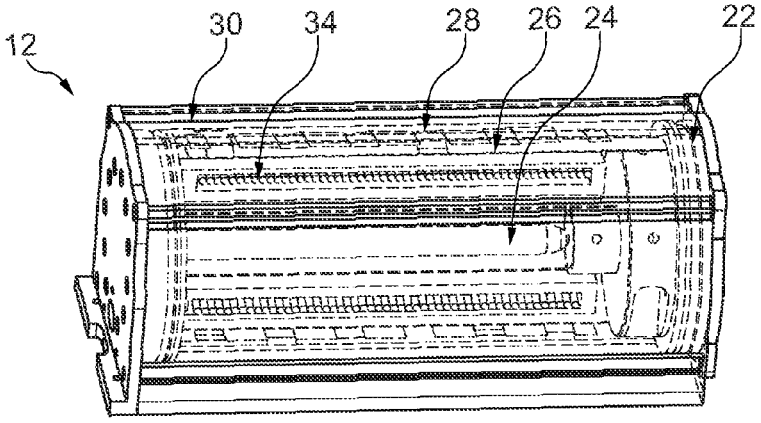

FIG. 4*c* also shows heat exchanger device 12 with housing 30, coil housing 34 and induction coil 32, and inner mandrel 68, which is disposed centrally to induction coil 42. Flat heating elements 24, 26, and 28 are also disposed rotationally symmetric around inner mandrel 68. First flat heating element 24 is disposed within coil 32, second flat heating element 26 is disposed outside induction coil 32, and third flat heating element 28 is disposed in fourth fluid channel 66 and divides fluid channel 66 into a first subchannel 70*a* and a second subchannel 70*b*. This division of fluid channels 46, 52, 66, 70*a*, 70*b* can be seen more clearly in FIG. 5.

Figure 5A:
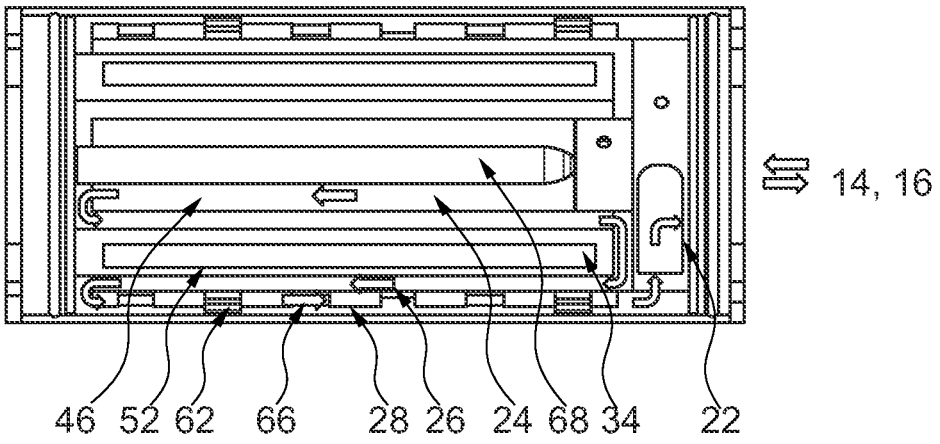
FIGS. 5*a*, 5*b* illustrate a heat exchanger device in a sectional illustration.
Figure 5B:
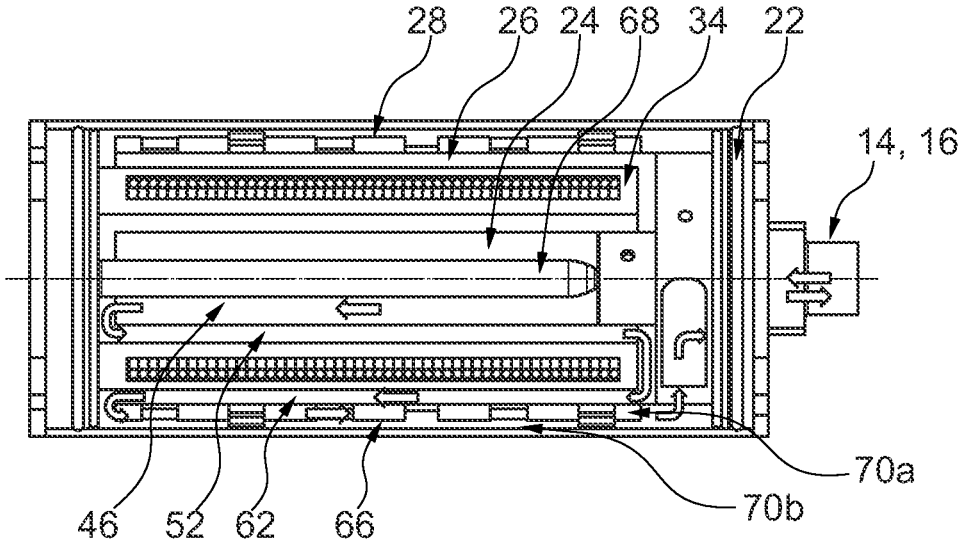

FIGS. 5*a* and 5*b* show heat exchanger device 12 also in a sectional illustration. In addition to the structure, shown in the preceding figures, of heat exchanger device 12, it can be seen how fluid inlet 14 and fluid outlet 16 are disposed and configured. Fluid inlet 14 is disposed in coolant connecting cover 22 next to fluid outlet 16, so that the fluid can flow centrally into first fluid channel 46 and can flow out of heat exchanger device 12 through fluid outlet 16, located next to inlet flange 14, in connecting flange 22.

The embodiment of connecting flange 22 of heat exchanger device 12 in FIGS. 5*a* and 5*b* is different from the embodiment shown in FIG. 1. Connecting flange 22 of FIG. 1 has fluid inlets and fluid outlets 14 and 16 located next to one another. Thus, two realized embodiments are shown for fluid inlet 14 and fluid outlet 16, particularly two embodiments for connecting flange 22.

Figure 6C:
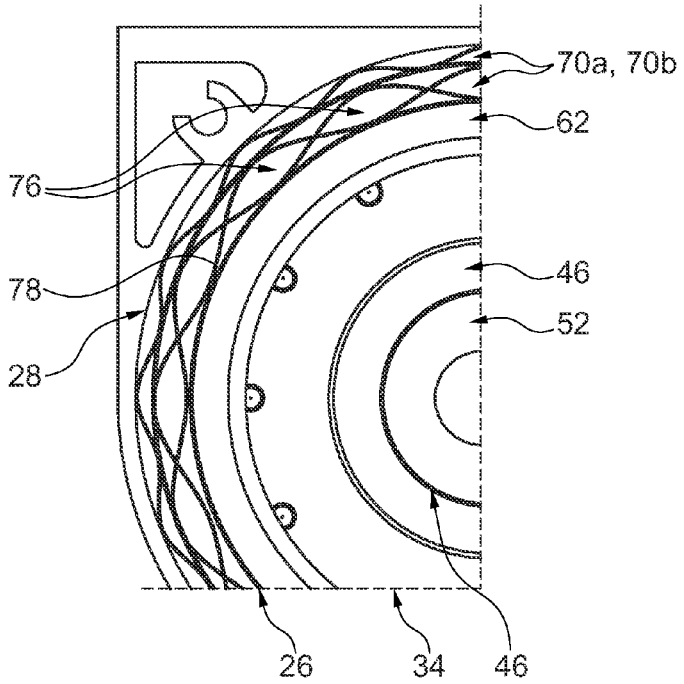
FIGS. 6*a*, 6*b*, 6*c* illustrate a flat heating element (FIGS. 6*a*, 6*b*) in a perspective illustration and the flat heating element in cross section (FIG. 6*c*)
Figure 6B:
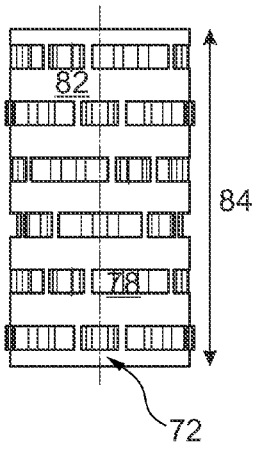
Figure 6A:
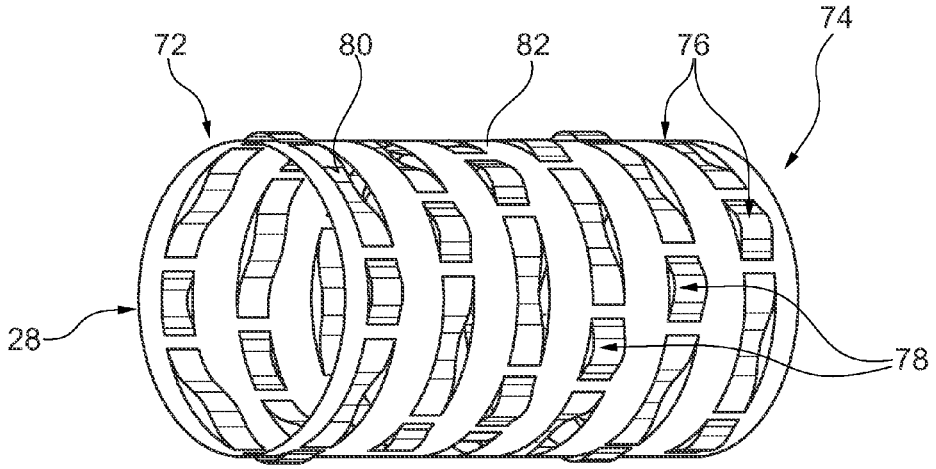

FIGS. 6*a*, 6*b*, and 6*c* show third flat heating element 28, which is formed as a hollow cylindrical body with a cylinder jacket 72. Third flat heating element 28 has openings 74 which are arranged in cylinder jacket 72 and can be formed as slits. Openings 74 can also be realized by forming bulges 76 on both sides on cylinder jacket 72. Bulges 76 are created by forming cylinder jacket sections 78 which extend over the circumference of cylinder jacket 72 and form a cylinder jacket band 78. Cylinder jacket band 78 is outwardly inverted or bulged outwardly alternately on the inner side of cylinder jacket 72 and on the outer side of cylinder jacket 72. Thus, a fluid channel or flow course 80 is formed between a straight cylinder jacket section 82 and the outwardly inverted or bulging cylinder jacket section 78. Cylinder jacket bands 78 and 82 are, for example, approximately 0.1 mm to 10 mm high. The height of cylinder jacket bands 78 can be varied depending on the desired degree of mixing of the fluid and the number of cylinder jacket bands 78 and the height of cylinder jacket 72.

In the sectional illustration of FIG. 6*c*, it is evident that cylinder jacket bands 78 extend on both sides of cylinder jacket 72. The dimensions of bulges 76 of cylindrical cylinder jacket 72 can comprise peripherally different circular arc segments of the cylinder jacket circumference. Thus, flow courses 80 of different lengths can be formed.

Openings 74 can also be designed as slits or openings with a different shape. In this case, ribbing or ripples can act as bulges to function as spacers to second flat heating element 26. The openings in this case can also be simple punched out holes.

Flat heating element 28 can also be designed as a flat element, whereby the sections with bulges do not extend over cylinder jacket 72 but form flat bands, which are arranged alternating with straight sections or bands.

Figure 7:
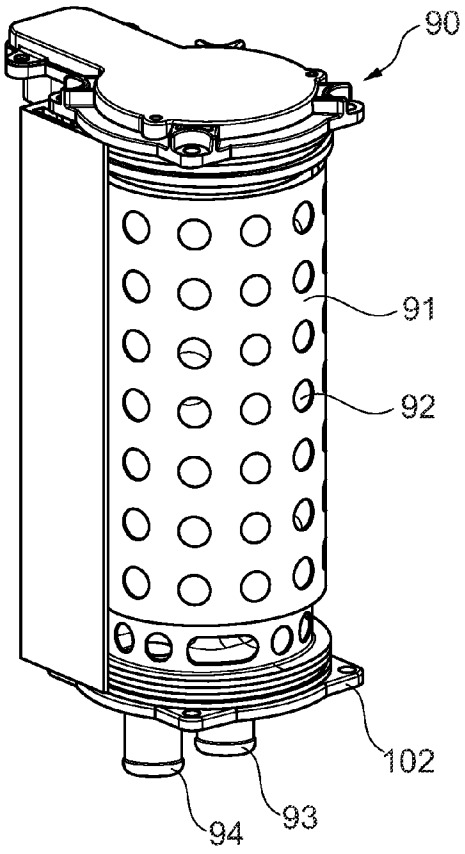
FIG. 7 is a perspective view of a heat exchanger device, whereby the outer flat heating element has circular openings as cross-mixing elements.

FIG. 7 shows an alternative embodiment of heat exchanger device 90, whereby third flat heating element 91 is designed as a cylindrical hollow body. Flat heating element 91 has a plurality of openings 92, which are distributed in the circumferential direction and in the axial direction and produced, for example, by a stamping process. Openings 92 in FIG. 7 are formed circular and are arranged in a uniform pattern in horizontal and vertical rows. Openings 92 function as so-called cross-mixing elements, which allow mixing of the fluid between the two subchannels, configured radially within and outside third flat heating element 91.

In alternative embodiments, different shapes can also be provided for the openings, such as, for example, rectangular, square, or elliptical cross sections. Moreover, the arrangement of the openings on the flat heating element can also be varied. The openings can be arranged randomly distributed, for example.

Furthermore, a coolant connecting cover 102, which has a fluid inlet 93 and a fluid outlet 94, is disposed at the bottom end region of heat exchanger device 90 of FIG. 7. Fluid inlet 93 is formed separate from fluid outlet 94, whereby both fluid inlet 93 and the fluid outlet are configured as cylindrical connecting pieces. Fluid inlet 93 and fluid outlet 94 are each in fluid communication with the fluid channels in the interior of heat exchanger device 90 via openings in coolant connecting cover 102.

Figure 8:
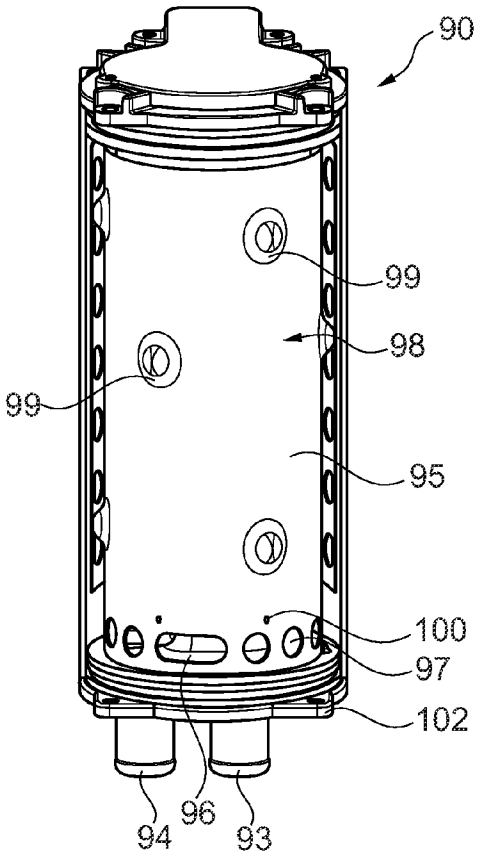
FIG. 8 is a perspective view of the heat exchanger device according to FIG. 7, whereby the middle flat heating element is depicted with a plurality of nub-like projections, which are formed from the inside toward the outside.

FIG. 8 shows a sectional view through heat exchanger device 90 of FIG. 7. The outer flat heating element 91 is shown in a cut view, as a result of which middle flat heating element 95 can be seen. Second flat heating element 95 has at its bottom end region a plurality of openings 96, 97, whereby both elongated hole-like openings 96 and circular openings 97 are formed. Openings 96, 97 are arranged in the circumferential direction along the bottom end region of second flat heating element 95. In the exemplary embodiment of FIG. 8, openings 96, 97 are arranged in a horizontal row distributed along the circumference.

Passing of fluid between a fluid channel, disposed in the radial direction outside second flat heating element 95, and a flow region, disposed within second flat heating element 95, can be made possible by openings 96, 97. The accordingly internally disposed flow region is preferably in fluid communication with fluid outlet 94. As illustrated in the following FIG. 9, the internally disposed flow region is preferably formed by an annular groove located in coolant connecting cover 102.

Furthermore, second flat heating element 95 has on its outward directed surface 98 nub-like projections 99 which act as spacers to third flat heating element 91. Nub-like projections 99 are formed, for example, by an embossing process from the inner surface in second flat heating element 95. Nub-like projections 99 have the shape of a cone, which has its base on outer surface 98 of second flat heating element 95 and then tapers.

The tips of nub-like elements 99 lie against the inwardly directed surfaces of third flat heating element 91, as a result of which a distance between second flat heating element 95 and third flat heating element 91 is realized. In an advantageous embodiment, third flat heating element 91 is connected at the tips of the nub-like projections 99 to second flat heating element 95. This can be achieved, for example, by staking, spot welding, or some other fixation method. A plurality of nub-like projections 99 are arranged on second flat heating element 95 in the circumferential direction and in the axial direction. A relative movement of third flat heating element 91 with regard to the other elements is prevented by a fixed connection of third flat heating element 91 to second flat heating element 95; this is advantageous especially during assembly, because third flat heating element 91 cannot unintentionally come into contact with an inner surface of the housing of heat exchanger device 90, as a result of which catching or wedging could arise.

In addition, FIG. 8 shows ventilation holes 100 at the bottom end region above openings 96, 97. These form a passage for air, which can form or collect at the bottom end region of the fluid channel within second flat heating element 95, particularly at the redirection region of the coil body. The air can flow outwards through ventilation holes 100 into the fluid channel formed between second flat heating element 95 and third flat heating element 91 and from there flow out of heat exchanger device 90 through fluid outlet 94.

In an especially preferred mounting position, heat exchanger device 90 is oriented in such a way that fluid inlet 93, fluid outlet 94, and ventilation holes 100 are oriented upwards. In FIGS. 7 and 8, heat exchanger device 90 is upside down in comparison with the preferred mounting position. This also applies to heat exchanger device 12 in the preceding FIGS. 3 to 5.

Figure 9:
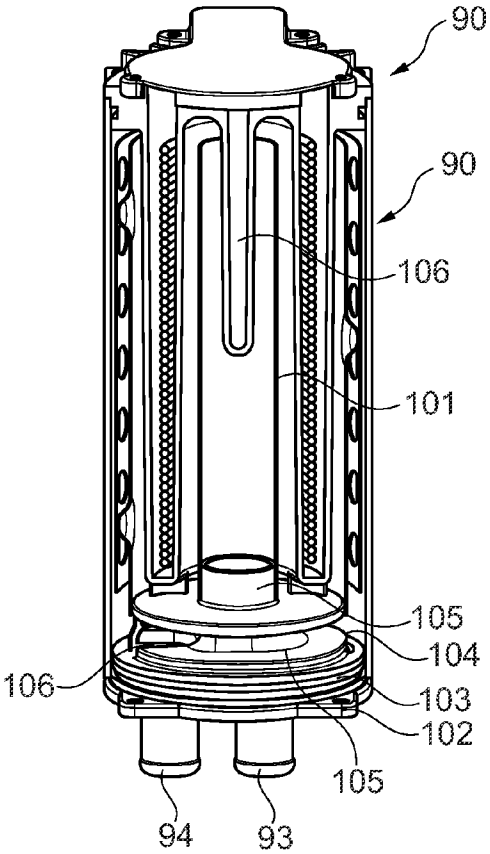
FIG. 9 is a further perspective view of the heat exchanger device according to FIGS. 7 and 8, whereby all three flat heating elements are shown in a cut view.

FIG. 9 shows a further sectional view of heat exchanger device 90, whereby second flat heating element 95 and first flat heating element 101 are also illustrated in a cut view. In the exemplary embodiment of FIG. 9, inner mandrel 106 is shown with a much shorter extension in the axial direction than in the preceding FIGS. 4 and 5.

Coolant connecting cover 102 forms a socket-like area with three sections of different diameter. The diameters decrease in the upward direction from fluid connections 93, 94. The hollow cylindrical housing of heat exchanger device 90 with an inner surface abuts section 103 with the largest diameter. Second flat heating element 95 with an inner surface abuts section 104 located above. First flat heating element 101 with an inner surface abuts third section 105 lying above. Coolant connecting cover 102 thus forms in addition to fluid connections 93, 94 also the bottom boundary of the fluid channels formed by flat heating elements 101, 95, and 91. Coolant connecting cover 102 is inserted like a plug from below into flat heating elements 95 and 101 formed as a hollow cylinder and the housing of heat exchanger device 90.

Second section 103 has an annular groove 105, which runs in the circumferential direction and which is in fluid communication with fluid outlet 94 via an axial hole 106. Coolant connecting cover 102 furthermore has a bored hole 107, which is in fluid communication with fluid inlet 93 and penetrates coolant connecting cover 102 completely from bottom to top and opens into the fluid channel formed within first flat heating element 101.

Figure 10:
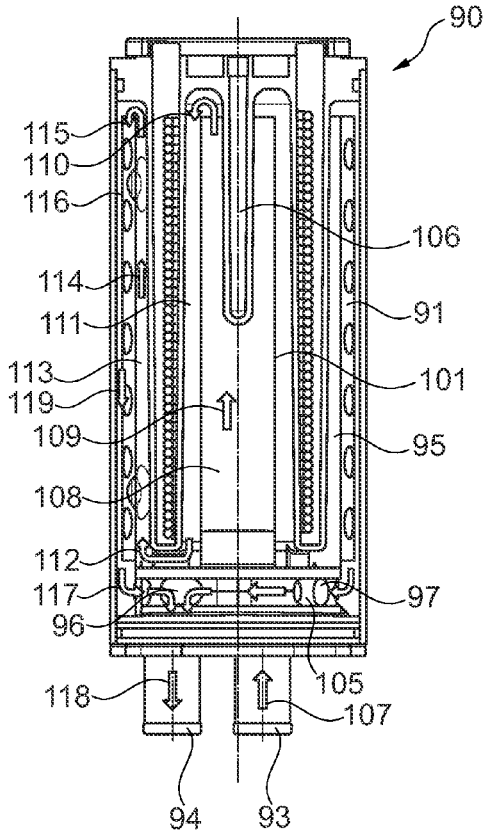
FIG. 10 is a sectional view through the heat exchanger device, whereby a flow-through principle of the heat exchanger device is shown by direction arrows.

FIG. 10 shows a flow pattern of heat exchanger device 90, whereby a fluid flows through fluid inlet 93 into first fluid channel 108, which is formed in the interior of first flat heating element 101, and flows upwards along direction arrow 109. At the upper end region the fluid is redirected by approximately 180° along direction arrow 110 over a gap between first flat heating element 101 and the top cover. The fluid flows downward in second fluid channel 111, which is formed between first flat heating element 101 and the coil body. There it is redirected by about 180° along direction arrow 112 and flows upward along direction arrow 114 in third fluid channel 113, which is formed between the coil body and second flat heating element 95. At the top end region of heat exchanger device 90, the fluid is redirected by approximately 180° along flow arrow 115, before it flows downward in fourth fluid channel 116 along direction arrow 119. Fourth fluid channel 116 is divided into two subchannels, whereby one subchannel is formed between third flat heating element 91 and second flat heating element 95 and one subchannel between third flat heating element 91 and the outer housing. The two subchannels are in fluid communication with one another via openings 92.

At the bottom end region, the fluid is redirected by approximately 90° along direction arrow 117 and flows through openings 96, 97, located in second flat heating element 95, into annular groove 105 from where the fluid flows along direction arrow 118 out of fluid outlet 94.

Figure 11:
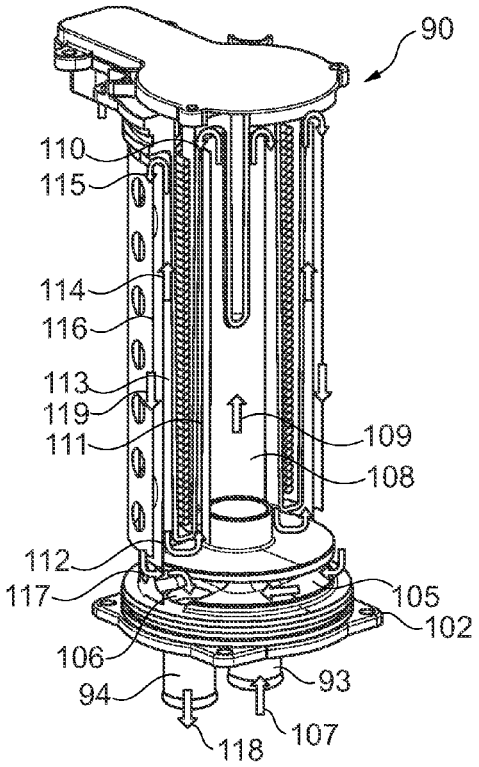
FIG. 11 is a perspective view of the heat exchanger device according to FIG. 10, whereby the flat heating elements are shown reduced, as a result of which the structure of the coolant connecting cover can be seen.

FIG. 11 shows a perspective view of heat exchanger device 90 of FIG. 10. The region in which the fluid flows over from annular groove 105 into bored hole 106 is shown especially well in FIG. 11. Second flat heating element 95 is shown shortened for this purpose in order to provide a view of annular groove 105.

Flat heating elements 91, 95, and 101 are preferably pressed together with sections 103, 104, and 105 of coolant closing cover 102. An advantageous connection is a conical pressure connection, which is produced with the use of casting bevels created during the production process of coolant connecting cover 102. For this purpose sections 103, 104, and 105 can also be configured advantageously in such a way that they taper conically when viewed from bottom to top, as a result of which pressing on of heating elements 91, 95, and 101 is facilitated.

In alternative embodiments, the flat heating elements can also be connected to the particular sections of the coolant connecting cover by staking, turned down tabs, or other fixation aids.

Figure 12:
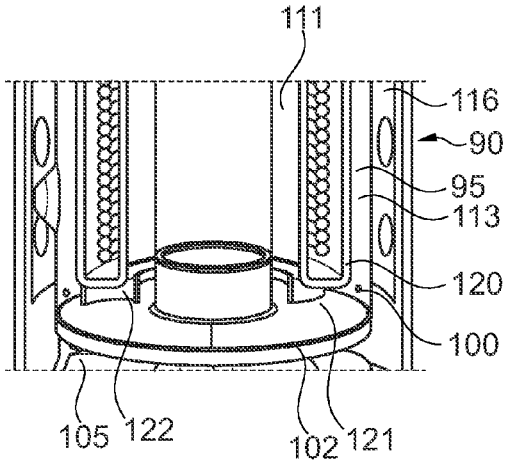
FIG. 12 is a detailed view of the bottom end region of the heat exchanger device of FIG. 9.

FIG. 12 shows a detailed view of the bottom end region of heat exchanger device 90 according to FIG. 9. Evident in particular is gap 121 which is formed between coolant connecting cover 102 and housing 120, in which the coil body is enclosed, and through which the fluid can flow between fluid channels 111 and 113. Spacer elements 122, which space apart housing 120 relative to coolant connecting cover 102, are arranged between housing 120 and coolant connecting cover 102. Spacer elements 122 have upward directed U-shaped receiving areas in which housing 120 is inserted.

In an alternative embodiment, the spacer elements can also have fastening devices, which produce a fixation between the coolant connecting cover and the housing. The fastening devices can be formed, for example, by snap-in hooks, detent elements, or clamping elements.

Further, ventilation holes 100 are shown in middle flat heating element 95, which function in particular for ventilating heat exchanger device 90. Air can flow through ventilation holes 100 out of fluid channel 113 into fluid channel 116. Fluid channels 113, 116 are arranged radially outside and radially inside middle flat heating element 95. The air finally can flow from the radially outward fluid channel 116 through openings 96, 97, which are not shown in FIG. 12, into annular groove 105 in coolant connecting cover 102 and from there through fluid outlet 94 out of heat exchanger device 90. This is particularly possible when heat exchanger device 90 is mounted in its preferred mounting position, whereby coolant connecting cover 102 in this preferred mounting position is located at the top end region of heat exchanger device 90.

Figure 13:
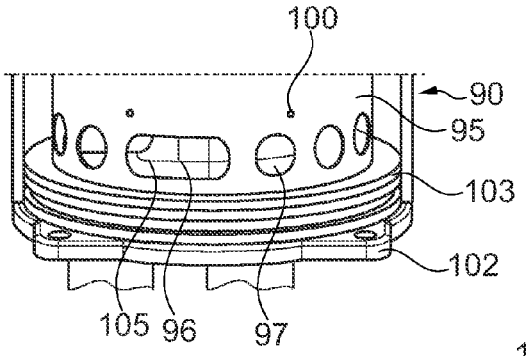
FIG. 13 is a detailed view of the bottom end region of the heat exchanger device of FIG. 8.

FIG. 13 shows a further detailed view according to FIG. 12, whereby flat heating element 95 is not shown in a cut view. Evident in particular are openings 96, 97 and ventilation holes 100, which are located at the bottom end region of flat heating element 95. Flat heating element 95 completely surrounds section 104 of coolant connecting cover 102 and sits on bottom section 103.

Figure 14:
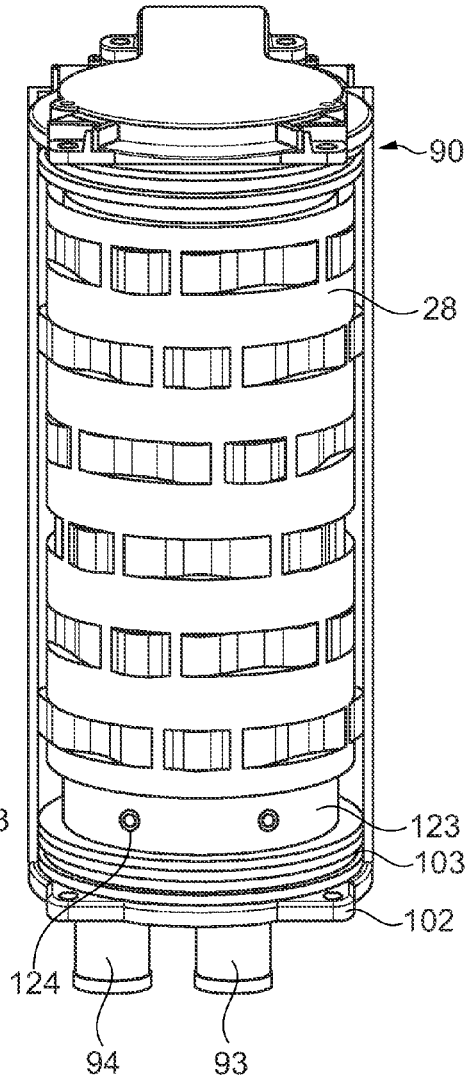
FIG. 14 is a view of a heat exchanger device as it is illustrated in FIGS. 7 to 10, whereby the outer flat heating element is formed by a flat heating element according to FIG. 6*a*.

FIG. 14 shows an alternative embodiment of heat exchanger device 90, whereby the outer flat heating element is realized according to flat heating element 28 of FIG. 6*a*. FIG. 14 thus shows in particular a combination of flat heating element 28, as it is shown in FIGS. 4*a*, 4*b*, 4*c*, 5*a*, 5*b*, 6*a*, 6*b*, and 6*c*, and a heat exchanger device 90, which has a coolant connecting cover 102 with fluid connections 93 and 94, configured separately from one another, and is shown in FIGS. 7 to 11.

Section 104 of coolant connecting cover 102 is surrounded by a ring-like element 123, which is connected via fastener 124 to coolant connecting cover 102. Ring-like element 123 has openings located facing away from the viewer and through which the fluid can flow into a flow region which is formed in section 104 and which can be formed, for example, as an annular groove.

The preceding FIGS. 1 to 14 are exemplary and serve to clarify the inventive concept. The individual features of the different exemplary embodiments can be combined with one another. FIGS. 1 to 14 are not limiting in nature, particularly with respect to the choice of materials and the geometry of the individual elements, as well as the arrangement of elements relative to one another.

In the present documents, heat exchanger, heat transfer device, and heat exchanger device are used synonymously. This also applies to the terms fluid channel or flow channel and flow subchannel or subchannel and flow path or flow course.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger device for a heater, the device comprising:

a housing with at least one fluid channel disposed therein;

a fluid inlet;

a fluid outlet;

an element generating an alternating magnetic field;

a metallic first flat heating element around which a fluid is adapted to flow on one or both sides, the first flat heating element provided at an interior of the element generating an alternating magnetic field;

a second flat heating element that surrounds an exterior of the element generating an alternating magnetic field; and a third flat heating element, which is configured to divide the at least one fluid channel into subchannels, the third flat heating element surrounding an exterior of the second flat heating element and the third flat heating element being surrounded by the housing, wherein the third flat heating element has cross-mixing elements that include openings via which the fluid flows through the third flat heating element, and wherein the first flat heating element is a tube and wherein one end of the fluid inlet is inserted into one end of the tube, such that the fluid flows from the fluid inlet into the first flat heating element.

2. The heat exchanger device according to claim 1, wherein a spacing is provided between the second flat heating element and the third flat heating element and/or a spacing is provided between the third flat heating element and an inner wall of the housing.

3. The heat exchanger device according to claim 1, wherein the third flat heating element divides the at least one fluid channel into subchannels such that a lowest possible pressure drop and a maximum possible heat removal to the coolant in the fluid channel are realized.

4. The heat exchanger device according to claim 3, wherein the third flat heating element has a geometric structure, which is configured to realize a turbulating and swirling of the fluid flowing through the subchannels.

5. The heat exchanger device according to claim 1, wherein the third flat heating element has impressions and/or ribbing.

6. The heat exchanger device according to claim 1, wherein the first, second and third flat heating elements are made of a material that has a higher electrical resistivity than the material of the element generating the alternating magnetic field.

7. The heat exchanger device according to claim 1, wherein the third flat heating element is made of a ferritic material.

8. The heat exchanger device according to claim 1, wherein the housing is cylindrical and wherein the third flat heating element is configured such that the third flat heating element is installed in the cylindrical housing.

9. The heat exchanger device according to claim 1, wherein the second flat heating element and the third flat heating element are connected to one another form-fittingly and/or by material bonding.

10. A heater comprising:

a heat exchanger device having a housing with at least one fluid channel disposed therein, a fluid inlet, and a fluid outlet and an element generating an alternating magnetic field;

a metallic first flat heating element around which a fluid flows on one or both sides, the first flat heating element provided at an interior of the element generating an alternating magnetic field;

a second flat heating element that surrounds an exterior of the element generating an alternating magnetic field;

a third flat heating element configured to divide the at least one fluid channel into subchannels, the third flat heating element surrounding an exterior of the second flat heating element and the third flat heating element being surrounded by the housing; and a control unit for controlling the element generating an alternating magnetic field and the flat heating elements, wherein the third flat heating element has cross-mixing elements that include openings via which the fluid flows through the third flat heating element, and wherein the first flat heating element is a tube and wherein one end of the fluid inlet is inserted into one end of the tube, such that the fluid flows from the fluid inlet into the first flat heating element.

11. The heat exchanger device according to claim 1, wherein the heater is a heater for a motor vehicle.

12. The heat exchanger device according to claim 1, wherein the openings of the cross-mixing elements extend entirely through a wall forming the third heating element.

13. The heat exchanger device according to claim 1, wherein the cross-mixing elements include a plurality of bulges provided around a circumference of the third flat heating element, the bulges being portions of the third flat heating element that either protrude from an outer side of the third flat heating element or protrude from an inner side of the third flat heat element in an alternating manner around the circumference of the third flat heating element, and wherein a slit is provided on each side of each of the bulges, the slits forming the openings.

14. The heat exchanger device according to claim 1, wherein an exterior surface of the second flat heating element is provided with projections that maintain a spacing between the second flat heating element and the third flat heating element.

15. The heat exchanger device according to claim 1, wherein one end of the second flat heating element is provided with openings around a circumference thereof.

16. The heat exchanger device according to claim 15, wherein the one end of the second flat heating element is provided with ventilation holes adjacent to the openings.

17. The heat exchanger device according to claim 1, wherein the element generating an alternating magnetic field is a coil, the coil being provided within a coil housing.

18. The heat exchanger device according to claim 1, wherein the first flat heating element is spaced apart from the interior of the element generating an alternating magnetic field, such that a fluid channel is formed between an outer wall of the first flat heating element and the element generating an alternating magnetic field.

* * * * *